US007267587B2

(12) United States Patent
Oguma et al.

(10) Patent No.: US 7,267,587 B2
(45) Date of Patent: Sep. 11, 2007

(54) STEERING SYSTEM OF OUTBOARD MOTOR

(75) Inventors: Takahiro Oguma, Shizuoka-ken (JP); Makoto Mizutani, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/089,929

(22) Filed: Mar. 25, 2005

(65) Prior Publication Data

US 2005/0215131 A1 Sep. 29, 2005

(30) Foreign Application Priority Data

Mar. 26, 2004 (JP) ..... 2004-091812

(51) Int. Cl.
*B63H 5/125* (2006.01)

(52) U.S. Cl. ..... 440/58; 440/59; 440/60

(58) Field of Classification Search ..... 440/58, 440/59, 60, 53
See application file for complete search history.

(56) References Cited

U.S. PATENT DOCUMENTS

| | | | | |
|---|---|---|---|---|
| 2,215,003 | A | 9/1940 | Johnson | |
| 2,224,357 | A | 12/1940 | Pecker | |
| 3,084,657 | A * | 4/1963 | Kiekhaefer | 440/52 |
| 3,233,691 | A | 2/1966 | De Biasi | |
| 3,310,021 | A * | 3/1967 | Shimanckas | 440/86 |
| 3,349,744 | A | 10/1967 | Mercier et al. | |
| 4,120,258 | A | 10/1978 | Spurgin | |
| 4,220,111 | A | 9/1980 | Krautkremer et al. | |
| 4,500,298 | A | 2/1985 | Hall et al. | |
| 4,519,335 | A | 5/1985 | Krautkremer et al. | |
| 4,787,867 | A | 11/1988 | Takeuchi et al. | |
| 4,872,857 | A | 10/1989 | Newman et al. | |
| 4,908,766 | A | 3/1990 | Takeuchi | |
| 4,909,765 | A | 3/1990 | Riske et al. | |
| 5,029,547 | A * | 7/1991 | Novey | 114/159 |
| 5,031,562 | A | 7/1991 | Nakase et al. | |
| 5,231,888 | A | 8/1993 | Katahira | |
| 5,235,927 | A | 8/1993 | Singh et al. | |

(Continued)

FOREIGN PATENT DOCUMENTS

JP 62-166193 7/1987

(Continued)

OTHER PUBLICATIONS

Co-Pending U.S. Appl. No. 11/384,616, filed Mar. 20, 2006. Title: Steering Control System for Boat.

(Continued)

*Primary Examiner*—Sherman Basinger
(74) *Attorney, Agent, or Firm*—Knobbe, Martens, Olson & Bear LLP

(57) ABSTRACT

A swivel bracket can be attached to a transom plate of a watercraft by means of a clamp bracket. A steering bracket can be rotationally provided in a swivel shaft of the swivel bracket. An outboard motor body can be secured to the steering bracket. An electric motor can be housed in the outboard motor and engaged with a stationary gear secured to the swivel bracket by way of a reduction gear. Driven by the electric motor, the steering bracket turns relative to the swivel bracket, causing the outboard motor body to turn.

6 Claims, 5 Drawing Sheets

U.S. PATENT DOCUMENTS

| | | | | |
|---|---|---|---|---|
| 5,244,426 | A | 9/1993 | Miyashita et al. | |
| 5,253,604 | A | 10/1993 | Bohlin | |
| 5,361,024 | A | 11/1994 | Wisner et al. | |
| 5,370,564 | A | 12/1994 | Fujimoto et al. | |
| 5,533,935 | A | 7/1996 | Kast | |
| 5,997,370 | A | 12/1999 | Fetchko et al. | |
| 6,079,513 | A | 6/2000 | Nishizaki et al. | |
| 6,230,642 | B1 | 5/2001 | McKeeney et al. | |
| 6,234,853 | B1 | 5/2001 | Lanyi et al. | |
| 6,273,771 | B1 | 8/2001 | Buckley et al. | |
| 6,402,577 | B1 * | 6/2002 | Treinen et al. | 440/61 R |
| 6,405,669 | B2 | 6/2002 | Rheault et al. | |
| 6,471,556 | B1 | 10/2002 | Yamashita et al. | |
| 6,511,354 | B1 | 1/2003 | Gonring et al. | |
| 6,535,806 | B2 | 3/2003 | Millsap et al. | |
| 6,655,490 | B2 | 12/2003 | Andonian et al. | |
| 6,671,588 | B2 | 12/2003 | Otake et al. | |
| 6,678,596 | B2 | 1/2004 | Husain et al. | |
| 6,843,195 | B2 | 1/2005 | Watabe et al. | |
| 6,892,661 | B2 | 5/2005 | Kishi et al. | |
| 6,892,662 | B2 | 5/2005 | Watanabe et al. | |
| 7,063,030 | B2 | 6/2006 | Mizutani | |
| 2003/0150366 | A1 | 8/2003 | Kaufmann et al. | |
| 2003/0224670 | A1 * | 12/2003 | Takada et al. | 440/61 S |
| 2003/0224672 | A1 * | 12/2003 | Takada et al. | 440/75 |
| 2004/0007644 | A1 | 1/2004 | Phelps et al. | |
| 2004/0031429 | A1 | 2/2004 | Kaufmann et al. | |
| 2004/0121665 | A1 | 6/2004 | Mizuguchi et al. | |
| 2004/0139902 | A1 | 7/2004 | Takada et al. | |
| 2004/0139903 | A1 | 7/2004 | Watabe et al. | |
| 2005/0170712 | A1 | 8/2005 | Okuyama | |
| 2005/0170713 | A1 | 8/2005 | Okuyama | |
| 2005/0199167 | A1 | 9/2005 | Mizutani | |
| 2005/0199168 | A1 | 9/2005 | Mizutani | |
| 2005/0199169 | A1 | 9/2005 | Mizutani | |
| 2005/0282447 | A1 | 12/2005 | Okuyama | |
| 2006/0019558 | A1 | 1/2006 | Mizutani | |
| 2007/0049139 | A1 | 3/2007 | Mizutani | |

FOREIGN PATENT DOCUMENTS

| | | |
|---|---|---|
| JP | 01-314695 | 12/1989 |
| JP | 02-179597 | 7/1990 |
| JP | 02-227395 | 9/1990 |
| JP | 04-038297 | 2/1992 |
| JP | B-HEI 6-33077 | 5/1994 |
| JP | 2739208 B2 | 1/1998 |
| JP | 10-226346 | 8/1998 |
| JP | A-HEI 10-310074 | 11/1998 |
| JP | 2959044 | 7/1999 |
| JP | 2000-318691 | 11/2000 |
| JP | 2003-313398 | 11/2000 |
| JP | 3232032 | 9/2001 |
| JP | A-2002-331948 | 11/2002 |
| JP | A-2004-155282 | 6/2004 |

OTHER PUBLICATIONS

Co-Pending U.S. Appl. No. 11/354,491, filed Feb. 15, 2006. Title: Steering Control System for Boat.

Co-Pending U.S. Appl. No. 11/588,060, filed Oct. 25, 2006. Inventor: Mizutani. (submitted herewith) Title: Control Unit for Multiple Installation of Propulsion Units.

Co-Pending U.S. Appl. No. 11/515,600, filed Sep. 5, 2006. Inventor: Mizutani. (submitted herewith) Title: Steering System for a Small Boat.

Co-Pending U.S. Appl. No. 11/516,151, filed Sep. 5, 2006. Inventor: Mizutani. (submitted herewith) Title: Steering Method and Steering for Boat.

Co-Pending U.S. Appl. No. 11/593,393, filed Nov. 6, 2006. Inventor: Mizutani. (submitted herewith) Title: Electric Type Steering Device for Outboard Motors.

* cited by examiner

STEERING SYSTEM OF OUTBOARD MOTOR

PRIORITY INFORMATION

This application is based on and claims priority under 35 U.S.C. §119 to Japanese Patent Application No. 2004-091812, filed on Mar. 26, 2004, the entire contents of which is hereby expressly incorporated by reference herein.

BACKGROUND OF THE INVENTIONS

1. Field of the Inventions

The present inventions relate to a steering system for an outboard motor.

2. Description of the Related Art

Outboard motors are typically mounted on a transom plate of a watercraft by means of a clamp bracket. Steering systems for outboard motors typically are adapted to change the direction of the associated watercraft by turning the outboard motor from side to side about a swivel shaft.

Recently, steering systems have been proposed in which an electric motor is used for steering outboard motors. For example, Japanese Patent Publication No. JP-C-2959044 discloses such a system. The steering system described in this publication transforms the linear motion of a rack and pinion mechanism into rotary motion with a link mechanism to turn the swivel bracket. This turning motion of the swivel bracket steers the outboard motor body.

In this steering system, the electric motor is used as a source of driving force for turning a pinion of the rack and pinion mechanism. The electric motor and the rack and pinion mechanism are attached to a bracket that connects the outboard motor and the transom plate, and they are arranged inside of the transom plate (i.e. inboard side).

In this steering system, however, mounting bosses and stays for attaching the steering system must be provided on the bracket assembly (which includes the clamp bracket and the swivel bracket). This results in a complex structure and increases the size of the bracket assembly. It also leads to a complicated procedure for mounting the steering system to the watercraft. In addition, the steering system described above would occupy larger inboard space around the bracket due to a need for preventing the interference with other members when it is mounted to the bracket or when the outboard motor is in the tilt-up position.

SUMMARY OF THE INVENTION

An aspect of at least one of the embodiments disclosed herein includes the realization that the components of an electric steering system for an outboard motor can be concealed, and thus better protected, by mounting some of the steering system components within the outboard motor.

Thus, in accordance with an embodiment, an outboard motor steering system comprises a swivel bracket attached to a transom plate of a watercraft. An outboard motor is rotationally attached to a swivel shaft of the swivel bracket. Additionally, a drive device is configured to rotate the outboard motor about the swivel shaft, the drive device being mounted in the outboard motor.

In accordance with another embodiment, an outboard motor steering system comprises a swivel bracket attached to a transom plate of a watercraft. An outboard motor is rotationally attached to a swivel shaft of the swivel bracket. Additionally, drive means for driving the outboard motor to rotate about the swivel shaft is provided wherein the drive means is mounted in the outboard motor.

In accordance with yet another embodiment, an outboard motor comprises an outboard motor body including an engine and a cowling covering the engine. A steering system comprises a swivel bracket configured to be attached to a transom plate of a watercraft so as to support the outboard motor body. The swivel bracket includes a swivel shaft. Additionally, a drive device is configured to generate torque to rotate the outboard motor body about the swivel shaft, the entire drive device being mounted in the outboard motor.

BRIEF DESCRIPTION OF THE DRAWINGS

The above-mentioned and other features of the inventions disclosed herein are described below with reference to the drawings of the preferred embodiments. The illustrated embodiments are intended to illustrate, but not to limit the inventions. The drawings contain the following Figures.

DETAILED DESCRIPTION OF THE PREFERRED EMBODIMENT

Figure 1:
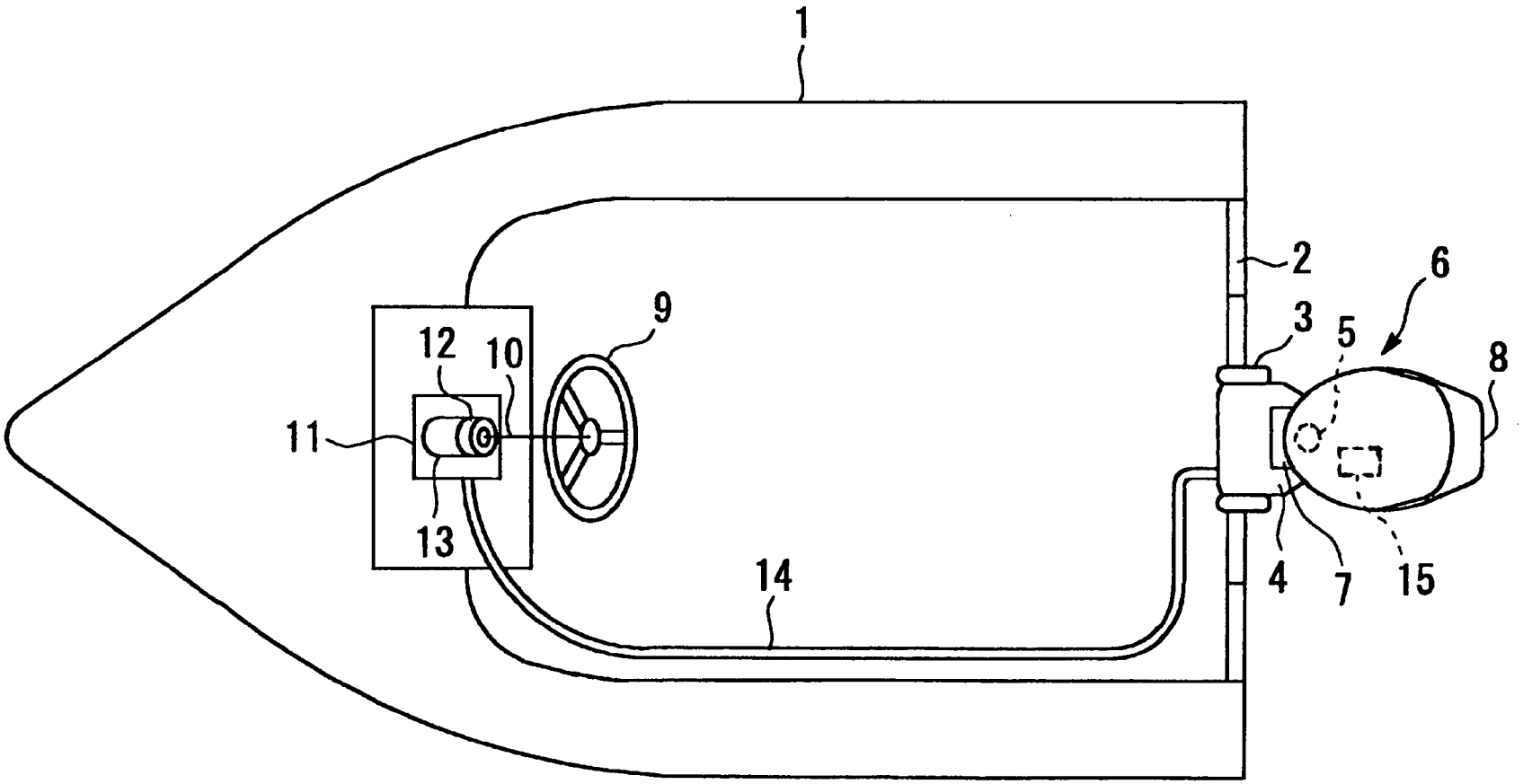
FIG. 1 is a schematic top plan view of a watercraft powered by an outboard motor with which the present steering system can be used.

FIG. 1 is a schematic top plan view of a small boat including an outboard motor with which the present embodiments are applicable. The embodiments disclosed herein are described in the context of an outboard motor for a small boat because these embodiments have particular utility in this context. However, the embodiments and inventions herein can also be applied to other marine vessels, such as personal watercraft and small jet boats, as well as other vehicles.

With continued reference to FIG. 1, a watercraft can include a hull 1 with a transom plate 2 at a rear end thereof. A swivel bracket 4 is mounted to the transom plate 2 of the hull 1 with a clamp bracket 3. The swivel bracket 4 is provided with a swivel shaft 5 that extends generally normal to the viewing direction of FIG. 1. The outboard motor 6 is rotatable about the swivel shaft 5, also referred to as a "steering shaft". The outboard motor 6 also includes constituted with a steering bracket 7 rotatably mounted about the swivel shaft 5. The main portion of the outboard motor 8 can be fixed at one end of the steering bracket 7.

A steering wheel 9 can be provided in the vicinity of an operator's seat in the hull 1. A steering wheel control section 11 can be provided at the root of a steering column shaft 10. A steering wheel operation angle sensor 12 and a reaction torque motor 13 can be provided inside the steering wheel control section 11, or at other locations.

The steering wheel control section 11 is connected, via a signal cable 14, to a controller 15 on the outboard motor 6, which in turn is connected to the electric motor 16 (FIG. 3) which can serve as a drive device for the steering system, described in greater detail below. In some embodiments, the motor 16 can be an electrically-operated hydraulic cylinder. The reaction torque motor 13 can be configured to apply a reaction force corresponding to the external force from the hull 1 to the steering wheel 9 so as to give operational feeling or "steering feedback" to the operator through the steering wheel 9.

Figure 2:
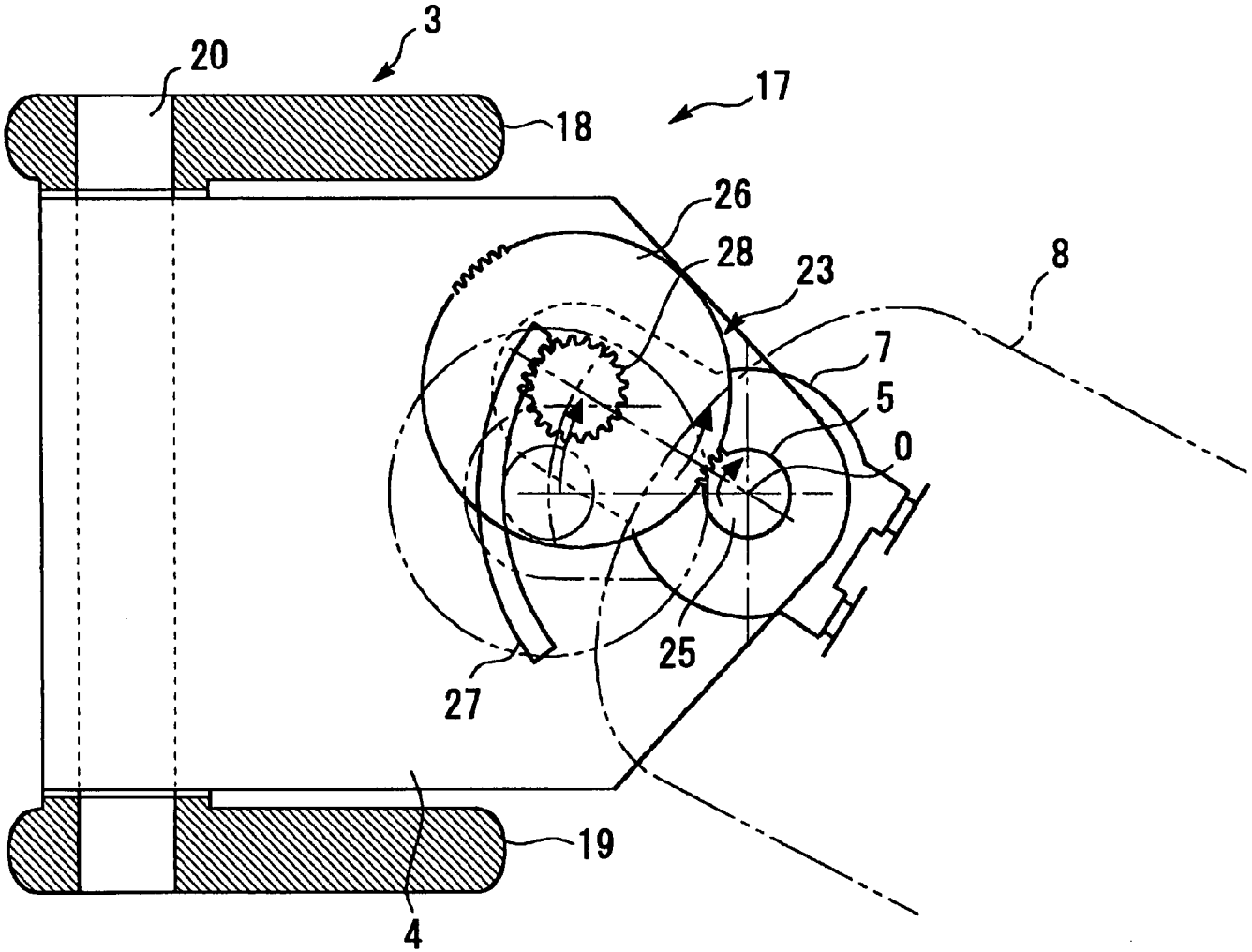
FIG. 2 is enlarged schematic top plan view of the outboard motor with an embodiment of the steering system and with certain internal components of the steering system shown in solid line in one position and in phantom line in a deflected position.
Figure 3:
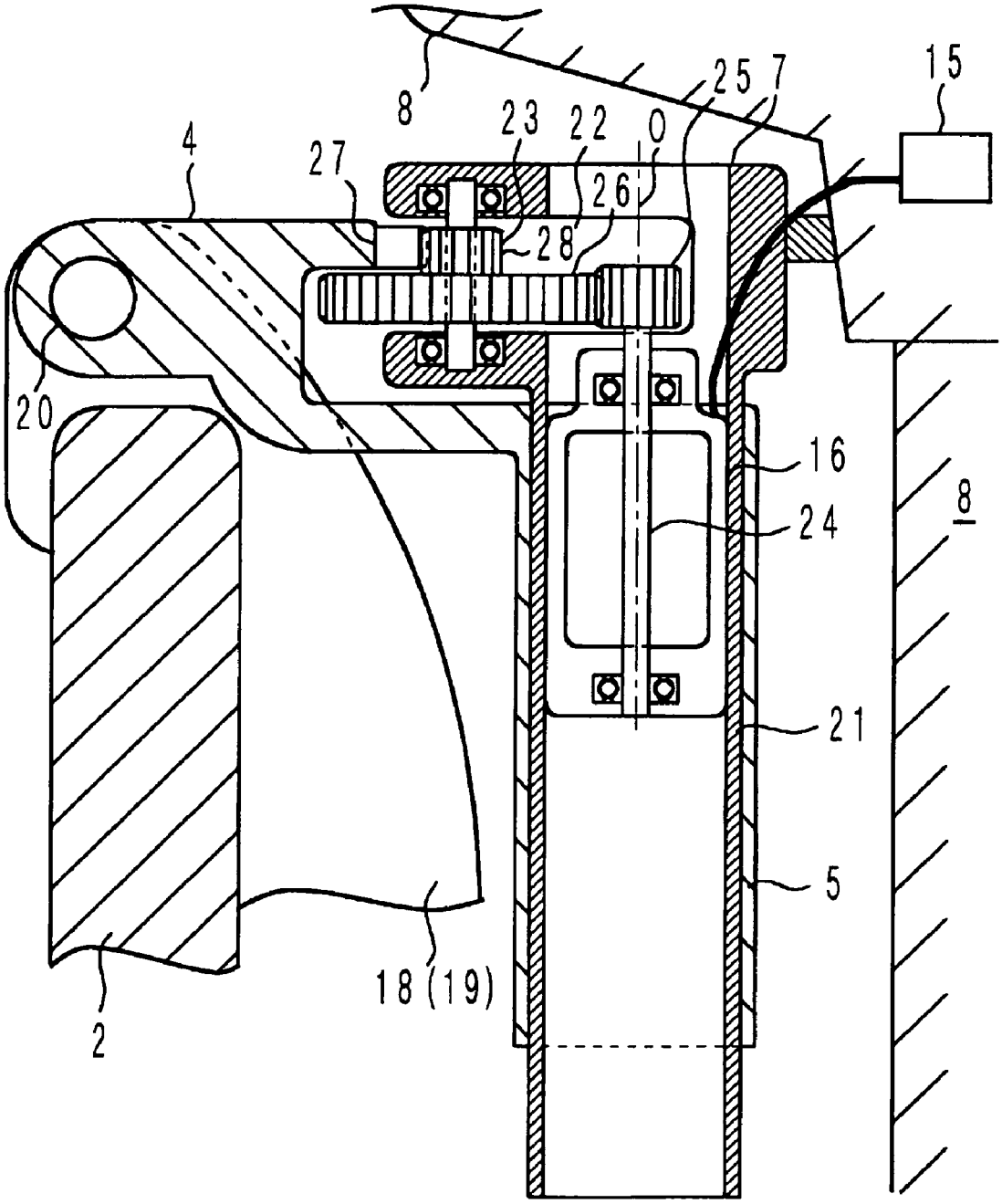
FIG. 3 is a schematic port-side elevational and partial sectional view of the components shown in FIG. 2 as well as other components.

FIGS. 2 and 3 illustrate a steering system 17 of the outboard motor according to an embodiment. FIG. 2 is a schematic plan view of the steering system, and FIG. 3 is a generally vertical sectional view.

The clamp bracket 3 includes a pair of clamping members 18, 19 that are fitted onto the transom plate 2. A tilt shaft 20 can be configured to connect the pair of the clamping members 18, 19 and to allow the outboard motor 6 to tilt about a tilt axis defined by the tile shaft 20.

A swivel bracket 4 can be rotationally attached to the tilt shaft 20 at the end of the watercraft. The swivel bracket 4 can be configured to extend outwardly toward the main part of the outboard motor 8, with its tip being formed with the swivel shaft 5 extending downwardly. A hydraulic tilt cylinder (not shown) can be attached to the clamp bracket 3, which, in conjunction with the swivel bracket 4, rotates the outboard motor body 8 about the tilt shaft 20, and also allows the outboard motor to tilt up as required (e.g., when a submerged object is struck during operation).

The swivel shaft 5 can be formed in the shape of a hollowed cylinder. This cylinder can be configured to receive a shaft portion 21 of a steering bracket 7 and to allow the shaft portion to rotate therein. Similar to the swivel shaft 5, the shaft portion 21 of the steering bracket 7 is hollowed, in which an electric motor 16 can be housed.

As shown in FIG. 3, one end of the steering bracket 7 that faces the tilt shaft 20 is open, forming a horseshoe shape in its sectional view. A speed reduction gear set 23 can be rotationally mounted in the recess of the horseshoe shape and configured to provide a gear reduction for the electric motor 16. The speed reduction gear set 23 can include a large diameter gear 26 engaging with a drive gear 25 that is secured to the tip of an electric motor output shaft 24, and a small diameter gear 28 engaging with a stationary gear 27 that is secured to the swivel bracket 4, although other configurations can also be used.

The stationary gear 27 is formed, as shown FIG. 2, with a shape of circular arc about an axial center 0 of the electric motor output shaft 24 and of the swivel shaft 5. As such, the gear 27 forms an arc-shaped rack-gear having gear teeth that face toward the smaller diameter gear 28 of the speed reduction gear set 23.

While the stationary gear 27 is secured on the swivel bracket 4, the steering bracket 7 having the speed reduction gear set 23 to engage the stationary gear 27 can make rotational motion relative to the swivel shaft 5 of the swivel bracket 4. Thus, as the electric motor 16 rotates according to a motor driving signal from a controller 12 and the drive gear 25 at the end of the electric motor output shaft 24 rotates, the reduction gear set 23 rotates correspondingly. Thus, the small diameter gear 28 of the reduction gear set 23 travels on the stationary gear 27 while making its rotating motion, which causes the steering bracket 7 and the shaft portion 21 to turn about the axial center 0 described above. In the embodiments where the stationary gear 27 is provided on the swivel bracket 4 a more compact structure is achieved.

As noted above, the steering bracket 7 secures the outboard motor body 8 on the side opposite to the reduction gear set 23. This allows the outboard motor body 8 to turn about the steering axial center 0 by means of the turning motion of the steering bracket 7. This permits the watercraft 1 to be steered.

Thus, because the electric motor 16 and the reduction gear set 23, which can be considered as forming "drive means", are disposed in the swivel bracket 4 and outside of the transom plate 2, the structure for mounting the steering system is simplified. In fact, in this embodiment, there is no need for any mounting structures on the inside or forward-facing side of the transom plate 2. This eliminates the steering system 17 from occupying inboard space around the tilt shaft 20, resulting in the availability of additional inboard space, and the prevention of interference of the steering system 17 with other members within the watercraft.

The structure of the swivel bracket 4 is also simplified because no steering system mounting structure is required for the swivel bracket 4. Since the electric motor 16 and the reduction gear set 23 are incorporated in the steering bracket 7, and thus can be considered to form a "unit", the outboard motor body 8 can be attached easily by engaging the reduction gear set 23 with the stationary gear 27 on the swivel bracket 4 side, resulting in a considerably simplified attachment procedure. In addition, the external appearance is improved as the electric motor 16 is covered with the shaft portion 21 of the steering bracket 7. It also reduces the potential of the electric motor 16 being damaged from water. Further, the space occupied by the drive means is greatly reduced as the electric motor 16 is placed inside of the shaft portion 21.

Figure 4:
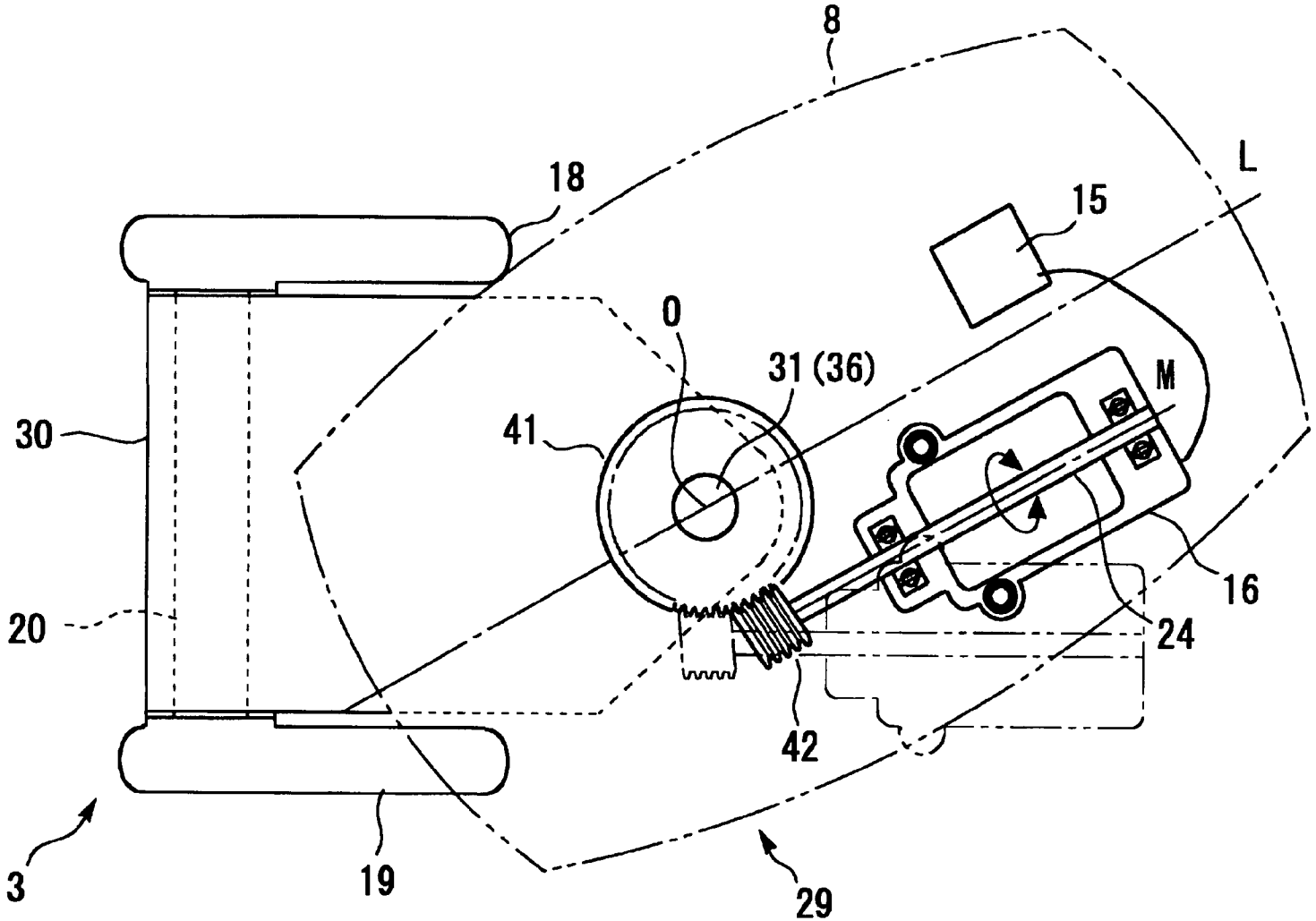
FIG. 4 is a schematic top plan view of a modification of the steering system shown in FIGS. 2-3 with steering system components shown in solid line in one position and in phantom line in a deflected position.
Figure 5:
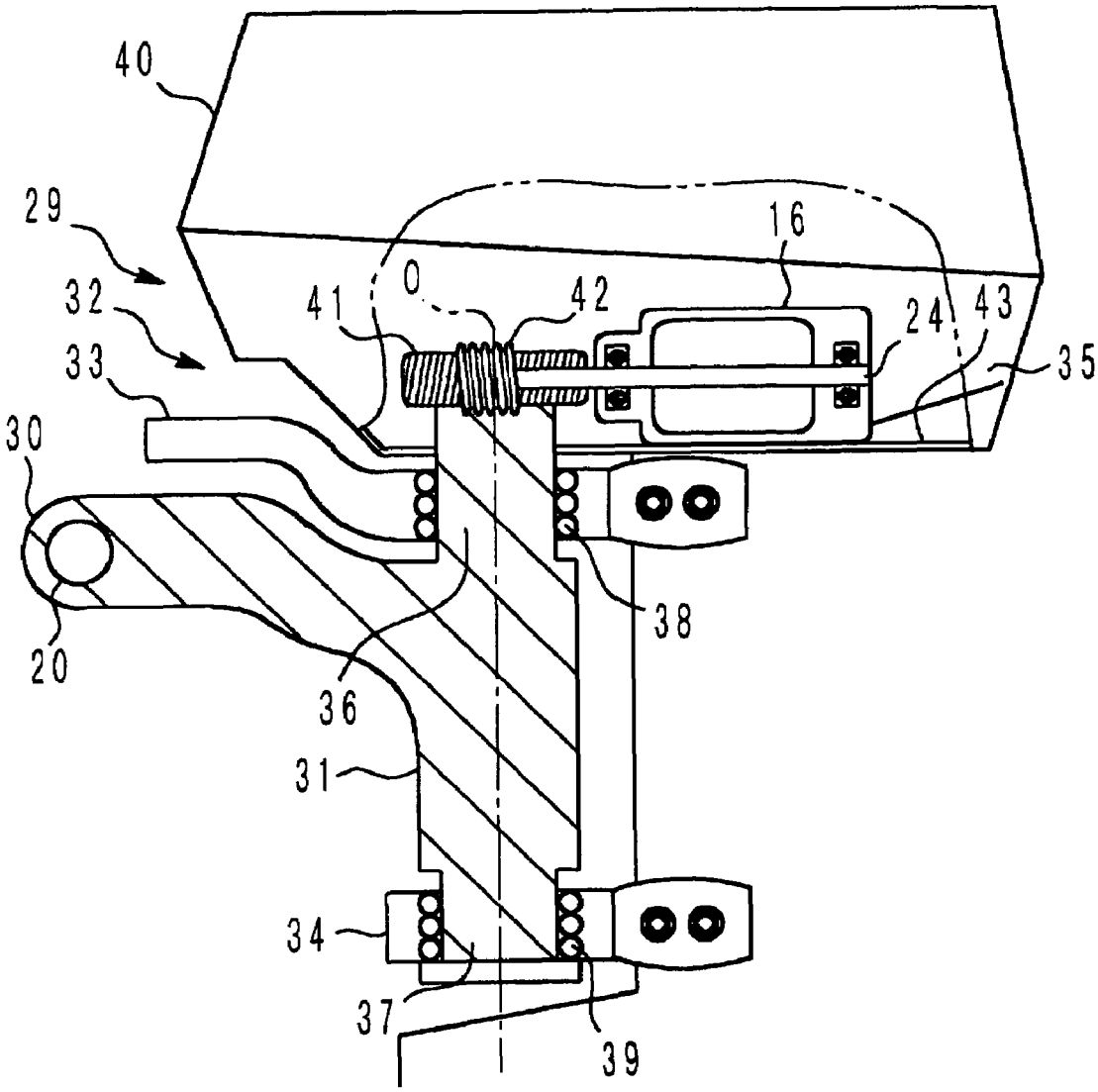
FIG. 5 is a schematic port-side elevational and partial sectional and partial cut-away view of the components shown in FIG. 4 as well as other components.

FIG. 4 and FIG. 5 illustrate a modification of the steering system 17 of FIGS. 1-3, identified generally by the reference numeral 29. FIG. 4 is a plan view and FIG. 5 is a vertical cross-sectional view of the steering system 29. In this embodiment, the components that can be identical or similar to those in the steering system 17 are identified with the same reference numerals.

Similarly to the steering system 17, a swivel bracket 30 of the steering system 29 can be rotationally attached to the tilt shaft 20 of the clamp bracket 3 at the end of the swivel bracket 30 on the watercraft side. The swivel bracket 30 can be configured to extend toward the main part of the outboard motor 32. As shown in FIG. 5, the swivel bracket 30 bends downwardly at about its middle portion, and is provided with a swivel shaft 31 at its distal end.

In some embodiments, the swivel shaft 31 of the swivel bracket 30 can be formed as a solid body, with the outboard motor 32 being mounted so as to be rotatable about the swivel shaft 31. In this embodiment, the outboard motor 32 includes a steering bracket 33 and a support bracket 34, both attached rotationally about the swivel shaft 31. A body 35 of the outboard motor 32 can be secured to one end of the brackets 33, 34.

Shaft portions 36, 37 can be provided at the upper and lower portions, respectively, along the swivel shaft 31 to support the steering bracket 33 and the support bracket 34 for rotation. In addition, ball bearings 38, 39 can be interposed between the brackets 33, 34 and the shaft potions 36, 37 respectively, to assure smooth turning of the outboard motor body 35 relative to the swivel bracket 30.

The upper shaft portion 36 of the swivel shaft 31 can protrude into the body 35 through a cowling (engine hood)

40 thereof. A stationary gear 41 can be secured at the distal end of the upper shaft portion 36. The stationary gear 41 can be formed as a circular gear having the same axial center 0 as of the swivel shaft 31.

In some embodiments, the electric motor 16 can be installed inside of the cowling 40 of the outboard motor body 35. As shown in FIG. 4 (plan view), the axis M of the electric motor output shaft 24 extends generally parallel to the longitudinal axis L of the outboard motor body 35, and extends along a tangential line of the stationary gear 41, however, the electric motor 16 can be disposed in any orientation within the cowling 40. In a positional relationship as described, the electric motor 16 is secured to the base 43 of the cowling 40 so that a worm gear 42 (equivalent to the drive gear in the claims) provided at the distal end of the electric motor output shaft 24, is engaged with the stationary gear 41.

The stationary gear 41 can be fixed to the swivel shaft 31. On the other hand, the body 35 to which the electric motor 16 having the worm, gear 42 engaging the stationary gear 41 is secured, is rotatable about the swivel shaft 31 via the steering bracket 33 and the support bracket 34. With this arrangement, the worm gear 42 disposed at the distal end of the electric motor output shaft 24 moves circumferentially on the outer periphery of the stationary gear 41, as the electric motor 16 rotates according to the motor driving signal from the controller 12.

FIG. 4 illustrates two orientations of the body 35, one drawn by a chain line and the other by a solid line, illustrating how the electric motor 16 along with the body 35 are displaced around the swivel shaft 31 by the driving force of the motor 16, and that the displacement of the motor 16 causes the outboard motor body 35 to rotate about the axial center 0 of the swivel shaft 31.

In this embodiment, installation of the steering system 29 within the cowling of the outboard motor body 35 results in the availability of additional inboard space, elimination of the steering system 29 occupying the space around the tilt shaft 20, as well as the prevention of interference of the steering system 29 with other members in the watercraft 1. Further, since the electric motor 16 and the stationary gear 41 are housed in the outboard motor body 35, not only these elements but also associated engaging members are covered with the cowling 40 of the outboard motor body 35, reducing the potential for these components to be damaged by water. In addition, installation of the stationary gear 41 on the swivel shaft 31 of the swivel bracket 30 results in less parts constituting the steering system 29, giving advantages in terms of cost and the ease of assembly.

Also, as the electric motor 16 is built into the outboard motor body 35, the mounting procedure of the outboard motor body 35 is simplified substantially, because the outboard motor body 35 can be attached by merely engaging the worm gear 42 on the electric motor 16 with the stationary gear 41 on the swivel bracket 30, resulting in a considerably simplified attachment procedure.

The embodiments disclosed herein have been described with reference to the two exemplified embodiments, but the disclosed steering systems are not limited to the configurations shown in these embodiments. With regard to the steering system 17, for example, the electric motor 16 is built in the steering bracket 7 connected to the outboard motor body 8. This arrangement can be altered by providing a component equivalent to the steering bracket 7 on the outboard motor body 8 so that the electric motor 16 can be built in the outboard motor body 8. Further, the reduction gear set 23 is interposed between the electric motor 16 and the stationary gear 27 for reducing the rotational speed of the electric motor 16. However, the reduction gears can be eliminated by employing a motor that produces high torques at low rotational speeds.

The inventions can be applied effectively to a watercraft on which some complicated mechanism and/or various members have to be disposed for the outboard motor on the inboard side around the tilt shaft of the clamp bracket secured to the transom plate. Further, the present inventions can be effectively applied to a small boat having an outboard motor or a stern drive, particularly to a rudder device using an electric motor.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An outboard motor steering system comprising a swivel bracket attached to a transom plate of a watercraft, an outboard motor rotationally attached to a swivel shaft of the swivel bracket, and a drive device configured to rotate the outboard motor about the swivel shaft, the drive device being mounted in the outboard motor, wherein the outboard motor includes an outboard motor body having a cowling enclosing an engine, the drive device being disposed within the cowling, wherein the drive device includes a rotary drive shaft and a drive gear at an end thereof, and wherein the swivel shaft of the swivel bracket is provided with a stationary gear disposed in the cowling and configured to mesh with the drive gear.

2. An outboard motor steering system comprising a swivel bracket attached to a transom plate of a watercraft, an outboard motor rotationally attached to a swivel shaft of the swivel bracket, and a drive motor configured to rotate the outboard motor about the swivel shaft, the drive motor being mounted in the outboard motor, wherein the outboard motor includes an outboard motor body and a steering bracket secured to the outboard motor body and attached to the swivel bracket to rotate about the swivel shaft, the steering bracket having a shaft portion, and wherein the drive motor is housed in the shaft portion of the steering bracket.

3. The outboard motor steering system according to claim 2, wherein the drive device includes a rotary drive shaft and a drive gear at an end thereof, the swivel bracket including a stationary gear configured to mesh with the drive gear.

4. The outboard motor steering system according to claim 3, wherein the drive device includes an electric actuator.

5. The outboard motor steering system according to claim 1, wherein the drive device includes an electric actuator.

6. The outboard motor steering system according to claim 2, wherein the drive device includes an electric actuator.

* * * * *